US007310904B2

(12) United States Patent
Ugolini et al.

(10) Patent No.: US 7,310,904 B2
(45) Date of Patent: Dec. 25, 2007

(54) METHOD AND MEANS FOR ADJUSTING THE SCOPE OF A FIREARM

(75) Inventors: Steve Ugolini, Ankeny, IA (US); Chris Schuling, Bondurant, IA (US)

(73) Assignee: Calculations Made Simple, LLC, Ankeny, IA (US)

( * ) Notice: Subject to any disclaimer, the term of this patent is extended or adjusted under 35 U.S.C. 154(b) by 0 days.

(21) Appl. No.: 11/566,868

(22) Filed: Dec. 5, 2006

(65) Prior Publication Data

US 2007/0101632 A1 May 10, 2007

Related U.S. Application Data

(62) Division of application No. 10/847,986, filed on May 18, 2004, now Pat. No. 7,162,825.

(51) Int. Cl.
*F41G 1/38* (2006.01)

(52) U.S. Cl. ..... 42/111; 42/119; 42/106; 42/130; 42/122; 42/135; 33/228; 33/297; 235/418; 235/405

(58) Field of Classification Search ..... 42/111, 42/119, 106, 130, 135, 137; 33/228, 297; 235/417, 418, 405, 406
See application file for complete search history.

(56) References Cited

U.S. PATENT DOCUMENTS 659,606 A 10/1900 Formby
3,340,614 A 9/1967 Leatherwood
4,285,137 A 8/1981 Jennie
4,311,902 A 1/1982 Koll
4,329,570 A 5/1982 Koll
4,389,791 A 6/1983 Ackerman
5,375,072 A 12/1994 Cohen
5,920,995 A 7/1999 Sammut
5,960,576 A 10/1999 Robinson
6,196,455 B1 3/2001 Robinson
6,516,699 B2 2/2003 Sammut et al.
6,845,567 B1 * 1/2005 Muncy ..... 33/506
2003/0140545 A1 7/2003 Huber
2003/0145505 A1 8/2003 Kenton
2004/0016168 A1 1/2004 Thomas et al.
2004/0020099 A1 2/2004 Osborn, II

OTHER PUBLICATIONS

Varmit al, "Varmit Al's Shooting Page"—Jul. 20, 2004.
Sight in Systems, Inc., "what Makes on Target Unique?"—http://web.archive.org/web/20000521233620/http://www.sightin.com/unique.htm, Feb. 22, 2006.

* cited by examiner

*Primary Examiner*—J. Woodrow Eldred

(57) ABSTRACT

A scope adjustment calculating apparatus and method for calculating adjustment to a scope on a firearm is disclosed. The scope adjustment calculating device displays multiple input criteria including: a plurality of division of minute of angle for a scope, a plurality of distance from a target data, and a plurality of shot placement spacing data. Known information of given division of minute of angle for a scope, given distance from a target, and given shot placement spacing from the target center point are selected from the input criteria. Based on this known information, a given number of adjustment increments needed to zero the scope is obtained from the calculating device, and the scope is zeroed based on the given number of adjustment increments.

4 Claims, 7 Drawing Sheets

| Shot Placement" (Distance off From Center) in inches | 25 YDS | 50 YDS | 75 YDS | 100 YDS | 125 YDS |
|---|---|---|---|---|---|
| 0.25 | 1 | 1 | 0.34 | 0.25 | 0.20 |
| 0.50 | 2 | 1 | 0.67 | 0.50 | 0.40 |
| 0.75 | 3 | 2 | 1.01 | 0.75 | 0.60 |
| 1.00 | 4 | 2 | 1.34 | 1 | 0.80 |
| 1.25 | 5 | 3 | 1.67 | 1.25 | 1 |
| 1.50 | 6 | 3 | 2.01 | 1.50 | 1.20 |
| 1.75 | 7 | 4 | 2.34 | 1.75 | 1.40 |
| 2.00 | 8 | 4 | 2.67 | 2 | 1.60 |
| 2.25 | 9 | 5 | 3.01 | 2.25 | 1.80 |
| 2.50 | 10 | 5 | 3.34 | 2.50 | 2 |
| 2.75 | 11 | 6 | 3.67 | 2.75 | 2.20 |
| 3.00 | 12 | 6 | 4.01 | 3 | 2.40 |
| 3.25 | 13 | 7 | 4.34 | 3.25 | 2.60 |

METHOD AND MEANS FOR ADJUSTING THE SCOPE OF A FIREARM

This application is a divisional of application Ser. No. 10/847,986 filed May 18, 2004 now U.S. Pat. No. 7,162,825.

BACKGROUND OF THE INVENTION

This invention is directed toward a method and means of adjusting or zeroing in a scope on a firearm. More specifically to adjusting or zeroing in a variety of different types of scopes with a variety of scope divisions of minute of angle (MOA's) under a variety of conditions.

Scopes are often mounted to a firearm to improve the firearm's accuracy. In using the scope to its fullest extent, a user must properly site the scope. In general, sighting of the scope involves zeroing the scope at a firing range or in the field to align the center point of the scope reticle with the impact location of the projectile. After zeroing the scope, the scope may be later adjusted for other conditions. Other conditions include any number of variables, including changes in wind conditions, parabolic drop, ballistic coefficients, bullet type, grain type, or the like. The most common of these conditions are wind conditions and parabolic drop. In both zeroing the scope and adjusting for these conditions, the scope is adjusted horizontally and vertically. Any horizontal adjustment is known as windage in the art; likewise, any vertical adjustment is known as elevation in the art.

As noted above, sighting of the scope often involves adjusting for other conditions. While these adjustments are related to efficient sighting of the scope, they are not directly related to zeroing the scope. Typically, a scope is zeroed first, then adjustments are made in the field from this zeroed position to adjust the scope for changes in conditions such as changes in wind conditions (affecting the horizontal path of the projectile) and parabolic drop (affecting the elevational path of the projectile). Many devices have been designed to adjust the scope for changes in wind conditions and parabolic drop in the field; however, these devices fail to provide a simple apparatus or method for zeroing the scope in the field.

Zeroing of the scope, as explained below is typically performed at a pre-determined distance of 25, 50, 75 or 100 yards or meters (at a firing range for example). During zeroing of the scope based on the pre-determined distance, a sighting shot or multiple sighting shots are delivered to a target. The vertical and horizontal shot placement spacing of the sighting shot (or a triangulated center of multiple sighting shots) from the target center point determines the adjustment needed for the specific scope to be properly zeroed. Scopes are typically adjusted based on one minute of angle, or divisions thereof. By coincidence, the width of one minute of angle of a degree at a radius of 100 yards is almost exactly one inch (1.0476 inches) or approximately 28 millimeters at 100 meters; likewise, one minute of angle at 200 yards is almost exactly two inches or approximately 56 millimeters. For example, a sighting shot at a distance of 100 yards striking a target 2 inches below and 3 inches to the right of the target center point requires a two minute of angle adjustment up and a three minute of angle adjustment to the left to properly zero the scope based on the predetermined distance of the test shot, and the type of scope used.

While this method is very accurate for zeroing the scope, it is problematic to apply in the field and to multiple scopes under multiple test distances. Specifically, without the benefit of the specific instructions for a specific scope at a pre-determined distance, one must recall the mathematical relationship between the distance to target, the shot placement spacing of the sighting shot (or shots) from the target center point, and the adjustment made to the specific type of scope required to zero in the scope.

In view of these problems, it is the object of this invention to provide a simple method and means for zeroing the scope based on the distance from a target, the shot placement spacing from the target center point, and the division of minute of angle adjustment available on the particular scope.

These and other objects will be apparent to those skilled in the art.

BRIEF SUMMARY OF THE INVENTION

A scope adjustment calculating apparatus and method for calculating adjustment to a scope on a firearm is disclosed. The scope adjustment calculating device displays multiple input criteria including: a plurality of division of minute of angle for a scope, a plurality of distance from a target data, and a plurality of shot placement spacing data. Known information of given division of minute of angle for a scope, given distance from a target, and given shot placement spacing from the target center point are selected from the input criteria. Based on this selected information, a given number of adjustment increments needed to zero the scope is obtained from the calculating device, and the scope is zeroed based on the given number of adjustment increments.

DETAILED DESCRIPTION OF THE PREFERRED EMBODIMENT

Figure 1:
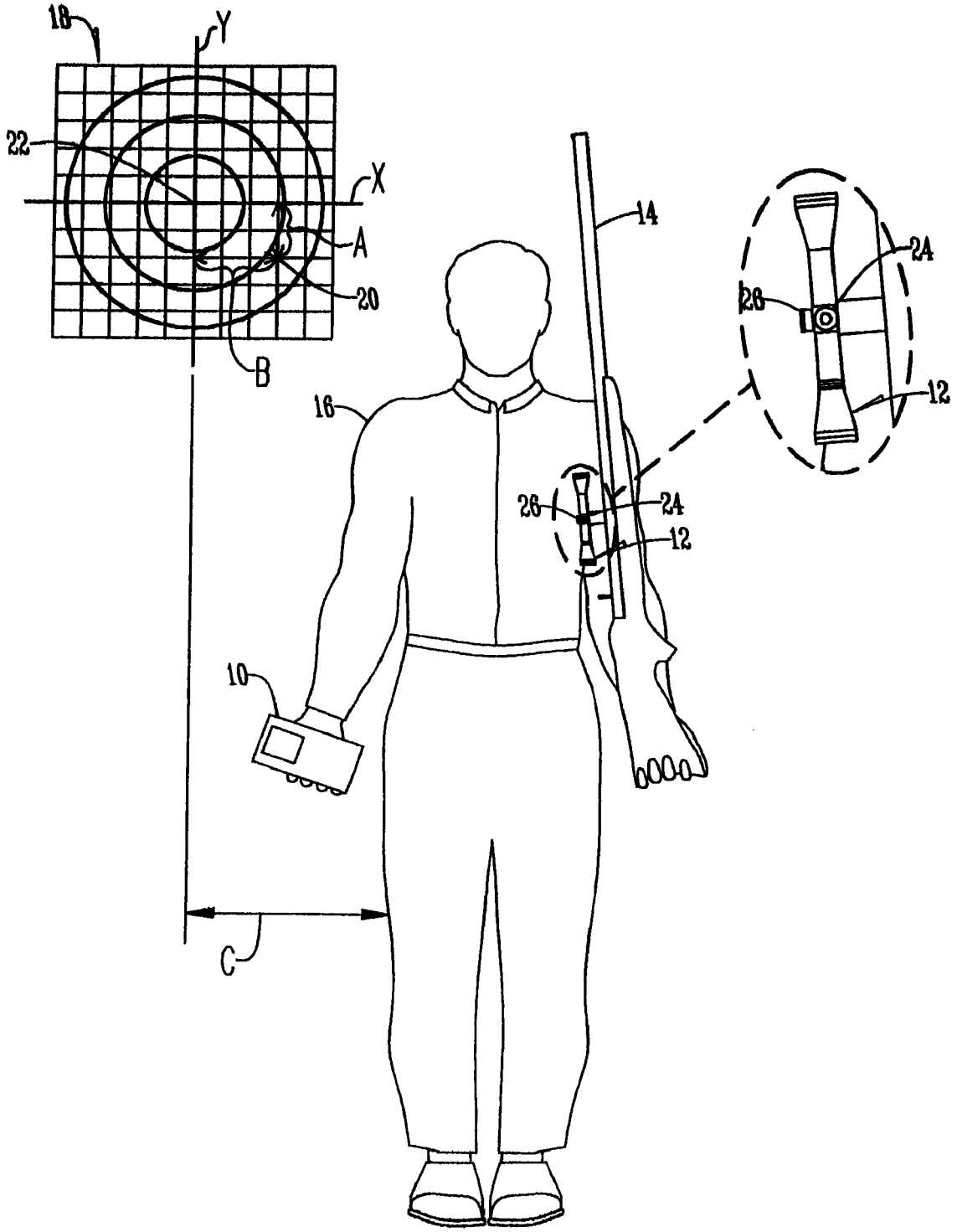
FIG. 1 is a schematic view of a user in the field with the present invention.

With reference to FIG. 1, a scope adjustment calculating device 10, for calculating adjustment to a scope 12 on a firearm 14, is disclosed. The scope adjustment calculating device 10 permits a user 16 to zero the scope 12 based on multiple input criteria. These multiple input criteria include the distance C of the user 16 from a target 18 when firing a sighting or test shot 20, the spacing coordinates (vertical shot placement spacing A or the y-coordinate and horizontal shot placement spacing B or the x-coordinate) from the target center point 22, and the division D (not shown) of minute of angle adjustment available on the particular scope 12.

As used herein the term "scope" includes but is not limited to sighting devices, and optical or telescopic scopes.

As used herein the term "firearm" includes but is not limited to rifles, pistols, shotguns, muzzleloaders, bows, crossbows, paint ball guns, or the like. As used herein the term "minute of angle" is referred to MOA in the art.

Zeroing of the scope 12 as discussed above, is done at any (random or pre-determined) distance C, for example 25, 50, 75 or 100 yards or meters. During zeroing of the scope 12, the sighting shot 20 or multiple sighting shots 20 are delivered to the target 18 while the scope 12 is aimed at target center point 22. Where multiple sighting shots 20 are delivered to the target 18, it is known in the art to determine a triangulated center of the multiple sighting shots 20, and then adjust the scope 12 based on this triangulated center. As used herein the term "sighting shot" encompasses a single sighting shot and/or the triangulated center of the multiple sighting shots.

The vertical spacing A and horizontal spacing B of the sighting shot 20 from the target center point 22 factor into the adjustment needed for the scope 12 to be properly zeroed. The vertical spacing A from the target center point 22 is a vertical distance measured along a Y-axis of the target 18, from the target center point 22 to a point on the Y-axis parallel to the sighting shot 20. Likewise, horizontal spacing B from the target center point 22 is a horizontal distance measured along an X-axis of the target 18, from the target center point 22 to a point on the X-axis parallel to the sighting shot 20.

The scope 12 is adjusted based on the division of minute of angle adjustment available on the particular scope 12 (one minute of angle, or divisions D thereof, including but not limited to: ½, ¼ or ⅛ minute of angle; millimeters: 5 mm, 10 mm, 15 mm, 3.5 mm, 7 mm, 14 mm; centimeters, decimals, fractions, and the like). As shown, a sighting shot 20 at a distance C of 100 yards striking the target 2 inches below (vertical shot placement spacing A) and 3 inches to the right (horizontal shot placement spacing B) of the target center point 22 requires a two minute of angle adjustment up and a three minute of angle adjustment to the left to properly zero the scope 12. Accordingly, the user 16 modulates an elevation adjustment 26 two minutes of angle up and modulates a windage adjustment 24 three minutes of angle to the left.

Figure 2:
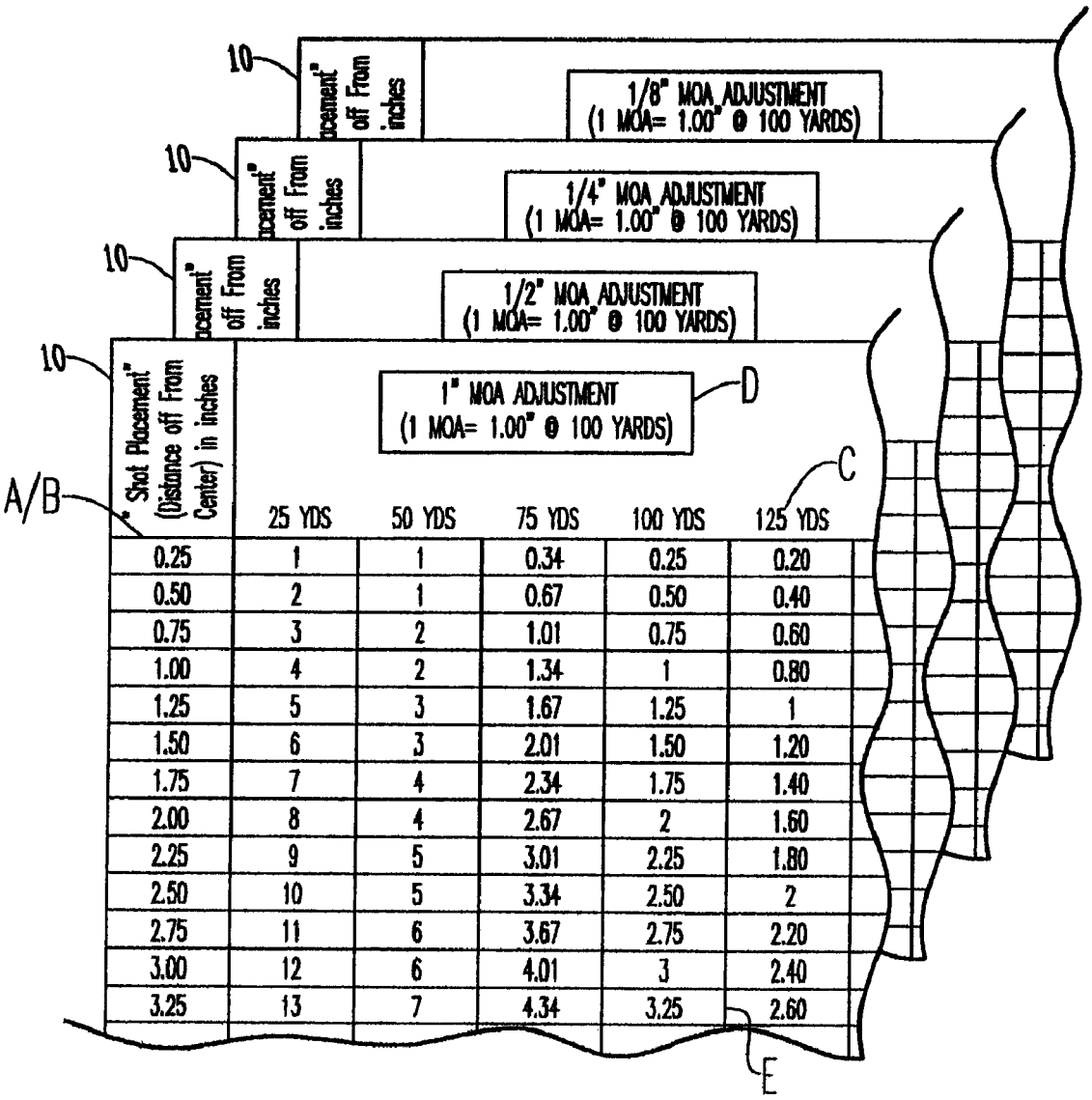
FIG. 2 shows a calculating device of the present invention embodied as a plurality of charts showing the number of scope adjustment increments needed to zero the scope to the target center point based on distance from the target and shot placement spacing from the target center point for a given division of minute of angle scope.

With reference to FIGS. 1 and 2, to facilitate the modulation of the elevation adjustment 26 and windage adjustment 24, the scope adjustment calculating device 10 displays multiple input criteria A or B, C, and D. These multiple input criteria include the distance C of the user 16 from a target 18 when firing the sighting shot 20, the sighting shot 20 placement spacing A or B from the target center point 22, and the division D of minute of angle adjustment available on the particular scope 12. Known information of given division of minute of angle for a scope, given distance from a target, and given shot placement spacing from the target center point are selected from the input criteria A or B, C, and D. Based on this selected information, a given number of adjustment increments E needed to zero the scope 12 are obtained from the calculating device 10, and the scope 12 is zeroed based on the given number of adjustment increments E for a selected scope zeroed in at a selected distance.

Figure 3:
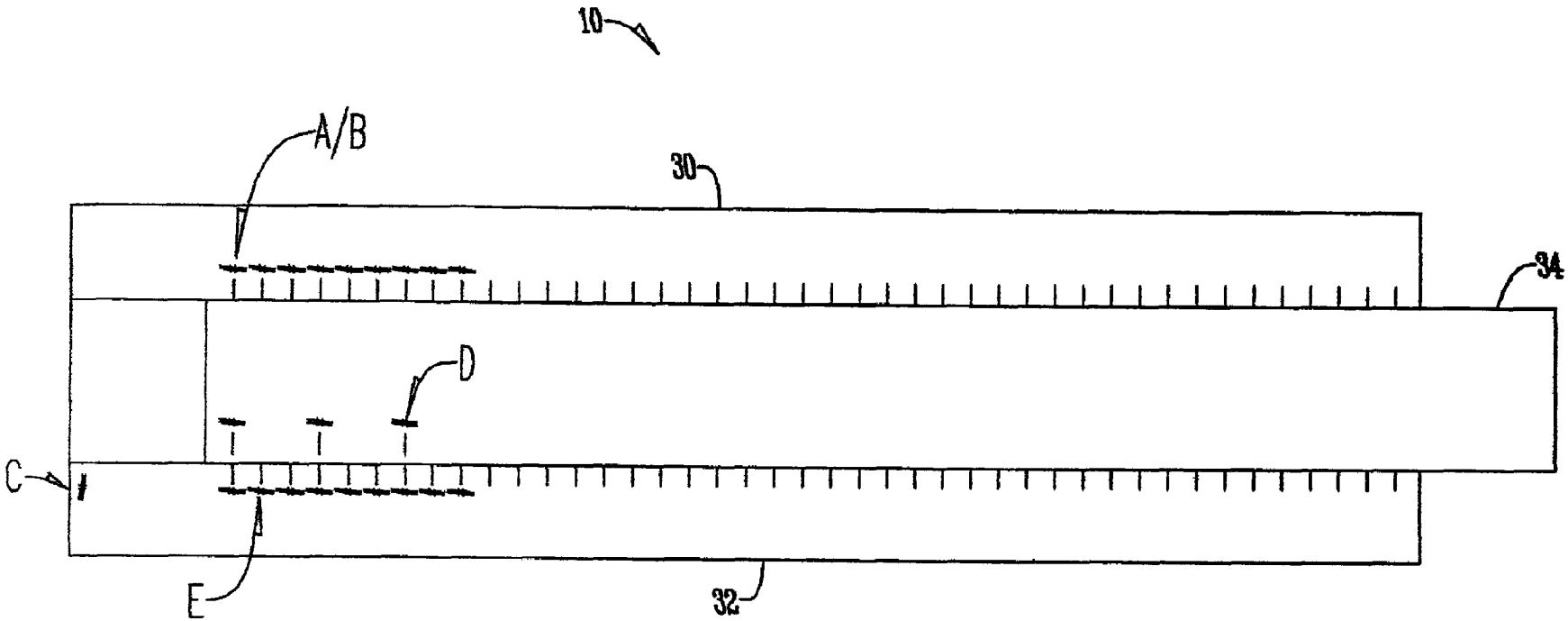
FIG. 3 is a front view of a slide rule calculating device of the present invention.
Figure 4A:
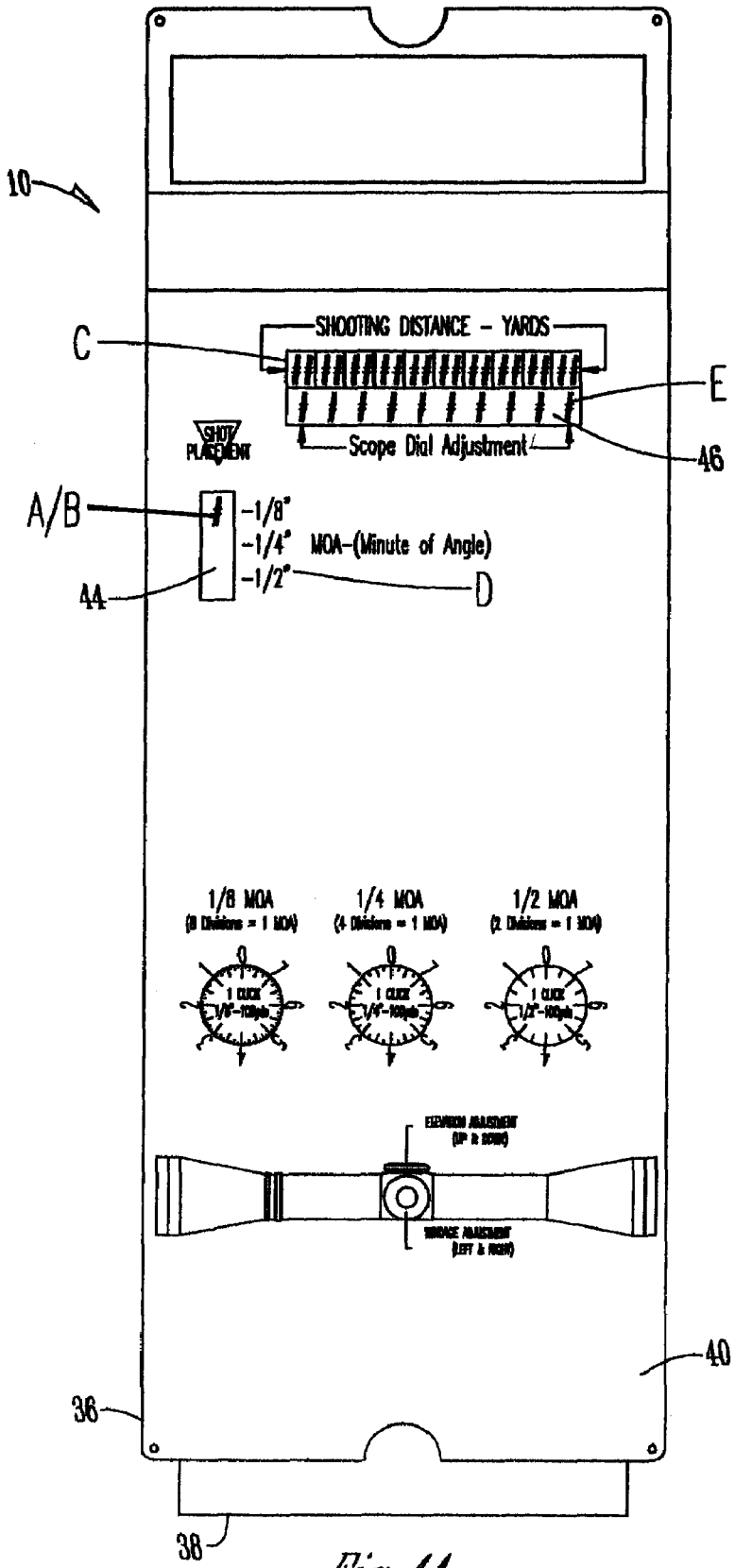
FIG. 4A is a front view of a slide chart calculating device of the present invention.
Figure 4B:
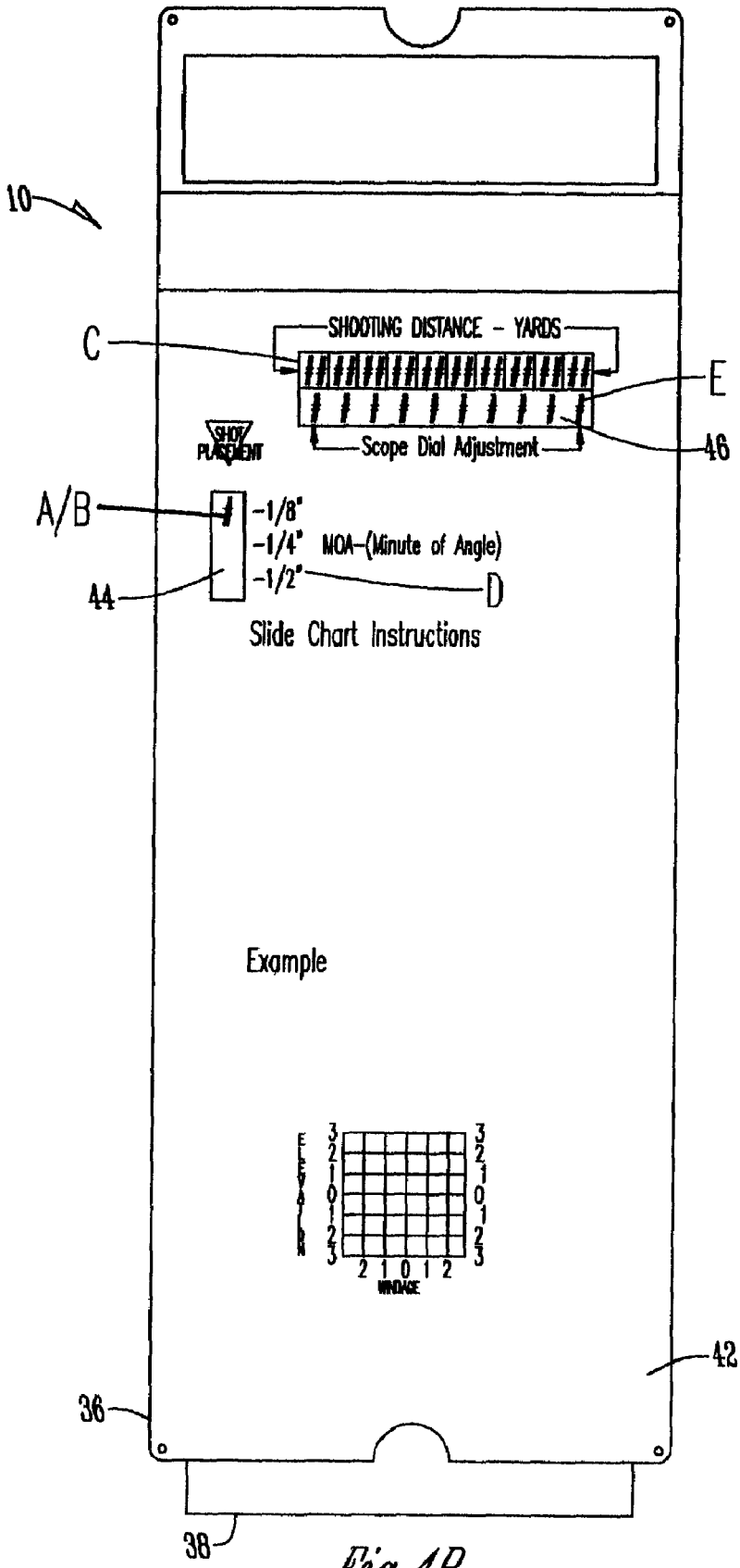
FIG. 4B is a back view of a slide chart calculating device of the present invention.
Figure 5:
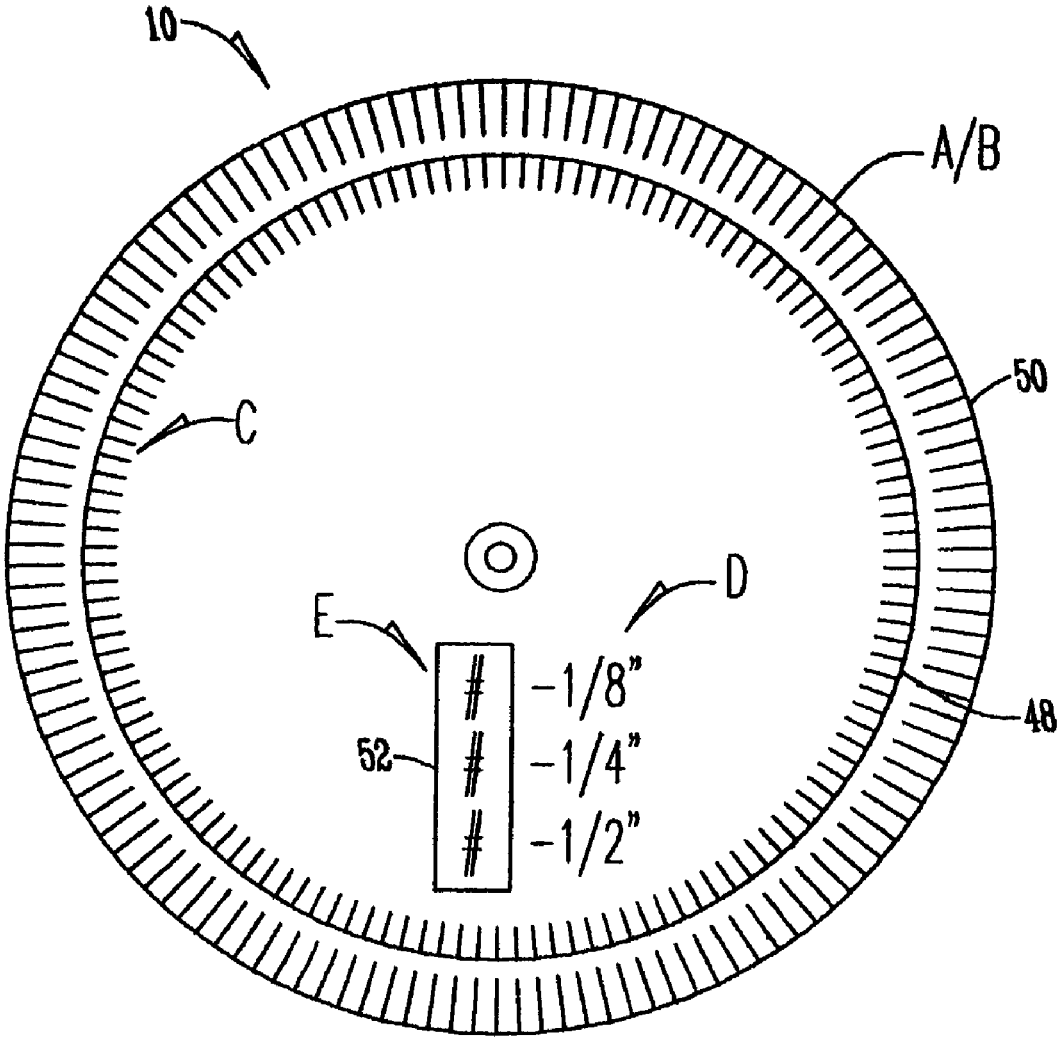
FIG. 5 is a front view of a wheel chart calculating device of the present invention.
Figure 6:
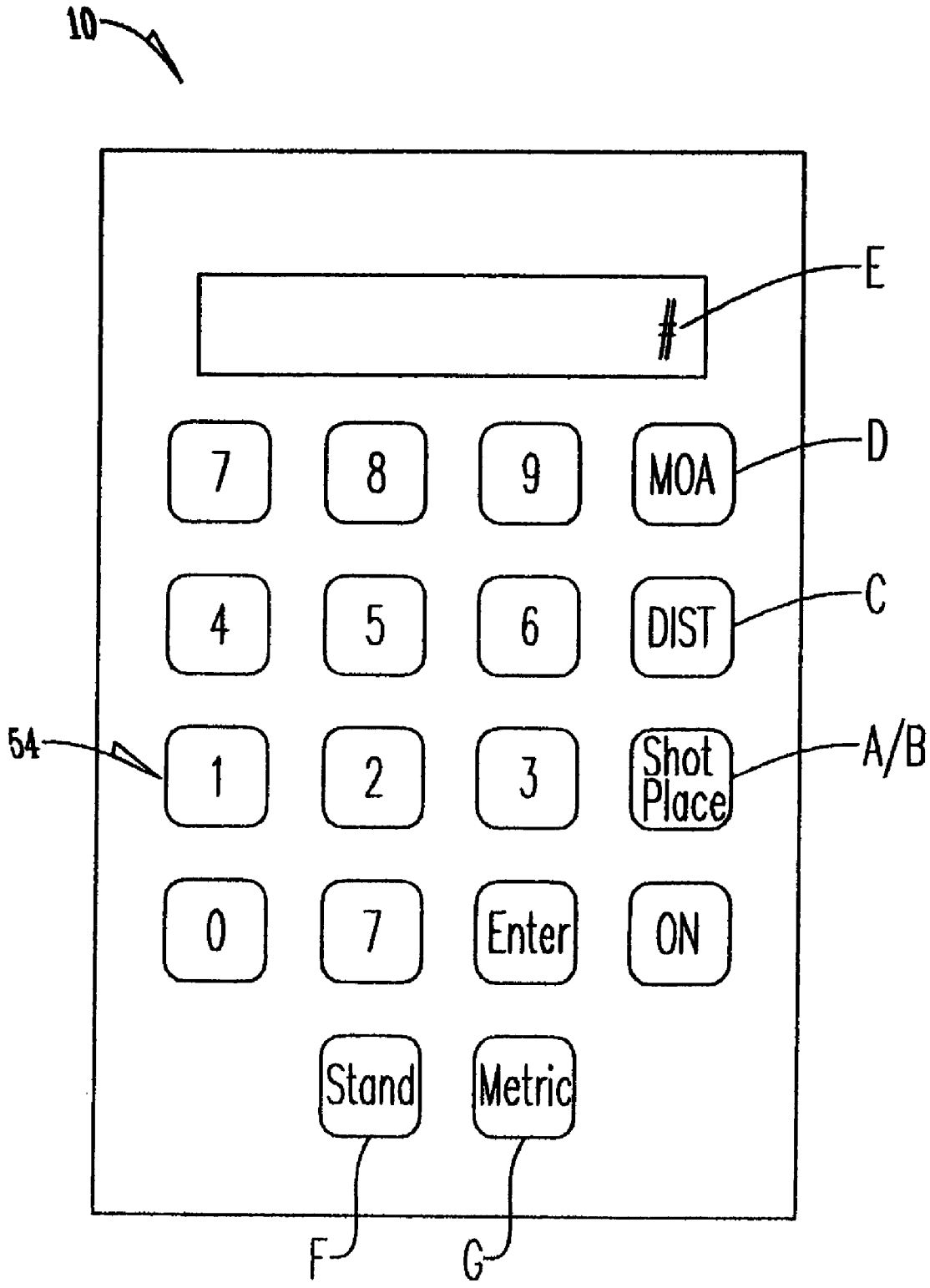
FIG. 6 is a front view of an electronic calculating device of the present invention.

The calculating device 10 can embody any known form, including but not limited to a chart (as shown in FIG. 2), a slide rule (as shown in FIG. 3), a slide chart (as shown in FIGS. 4A and 4B), a wheel chart (as shown in FIG. 5), or an electronic device such as a calculator (as shown in FIG. 6).

With reference to FIG. 2, where the calculating device 10 is a chart, the plurality of adjustment increments E are presented as a grid based on a given division D of minute of angle, a plurality of distances from a target C, and a plurality of shot placement spacings A or B from the target center 22. It will be understood to one of ordinary skill in the art that more than one arrangement of the adjustment increments E, divisions D of minute of angle, distances from a target C, and shot placement spacings A or B from the target center 22 is possible and/or desirable on the chart 10.

With reference to FIG. 3, where the calculating device 10 is a slide rule, the plurality of adjustment increments E are presented upon the slide rule 10 based on a given division D of minute of angle, a plurality of distances from a target C, and a plurality of shot placement spacings A or B from the target center 22. The adjustment increments E, a plurality of divisions D of minute of angle, a plurality of distances from a target C, and a plurality of shot placement spacings A or B from the target center 22 are arranged upon a first and second arm 30 and 32 respectively, as well as a slide member 34. It will be understood to one of ordinary skill in the art that more than one arrangement of the adjustment increments E, divisions D of minute of angle, distances from a target C, and shot placement spacings A or B from the target center 22 is possible and/or desirable on the slide member 34 and arms 30 and 32 of slide rule 10. It will be understood that the slide rule of FIG. 3 could also be provided with a back side that operates in a similar manner as the front side described above.

With reference to FIGS. 4A and 4B, where the calculating device 10 is a slide chart, the plurality of adjustment increments E are presented upon the slide chart 10 based on a given division D of minute of angle, a plurality of distances from a target C, and a plurality of shot placement spacings A or B from the target center 22. The adjustment increments E, a plurality of divisions D of minute of angle, a plurality of distances from a target C, and a plurality of shot placement spacings A or B from the target center 22 are arranged upon a slide member 38 received within jacket 36. It will be understood to one of ordinary skill in the art that more than one arrangement of the adjustment increments E, divisions D of minute of angle, distances from a target C, and shot placement spacings A or B from the target center 22 is possible and/or desirable on the slide member 38 or jacket 36 of slide chart 10. As the slide member 38 is moved with respect to jacket 36, various shot placement spacings A or B from the target center 22 appear in aperture 44 of the jacket 36. The chosen shot placement spacing A or B from the target center 22 is aligned with the appropriate division D of minute of angle on the jacket 36. Once this is done, a plurality of adjustment increments E are displayed in aperture 46 of the jacket 36 aligning with a corresponding plurality of distances from a target C on the jacket 36. A front side 40 and back side 42 of the slide chart 10 are shown in FIGS. 4A and 4B respectively, and are provided so that one double sided slide chart 10 contains twice the data of a single sided slide chart.

With reference to FIG. 5, where the calculating device 10 is a wheel chart, the plurality of adjustment increments E presented upon the wheel chart 10 based on a given division D of minute of angle, a plurality of distances from a target C, and a plurality of shot placement spacings A or B from the target center 22. The adjustment increments E, a plurality of divisions D of minute of angle, a plurality of distances from a target C, and a plurality of shot placement spacings A or B from the target center 22 are arranged upon an inner wheel 48 and an outer wheel 50. It will be understood to one of ordinary skill in the art that more than one arrangement of the adjustment increments E, divisions D of minute of angle, distances from a target C, and shot placement spacings A or B from the target center 22 is possible and/or desirable on the inner wheel 48 and outer wheel 50 of wheel chart 10. As the inner wheel 48 is moved with respect to the outer wheel 50, various adjustment increments E are displayed in aperture 52 of the inner wheel 48. It will be understood that the wheel chart of FIG. 5 could also be provided with a back side that operates in a similar manner as the front side described above.

With reference to FIG. 6, where the calculating device 10 is a calculator, the plurality of adjustment increments E are ascertained and displayed based on a given division D of minute of angle, a given distance from a target C, and a given shot placement spacing A or B from the target center 22 entered on pad 54 of the calculator 10. It will be understood to one of ordinary skill in the art that more than one arrangement of the adjustment increment E display, the division D of minute of angle punch key, the distance from a target C punch key, and the shot placement spacing from the target center A or B punch key is possible and/or desirable on pad 54 of the calculator 10. Additionally, a standard (i.e. English system in inches and yards) punch key F and a metric (i.e., millimeters, meters) punch key G are optionally supplied on pad 54 of the calculator 10, to shift the operation of the calculator between English and metric units.

Whereas the invention has been shown and described in connection with the embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A scope adjustment calculating device for use with a scope and a firearm, comprising:

a jacket having a plurality of apertures;

a slide member slidably received within the jacket; and printed indicia on the slide member and the jacket representing a plurality of shot placement spacings from a target center, a plurality of adjustment increments, a plurality of distances from a target, and a plurality of divisions of minute of angle, the printed indicia positioned on the slide member and the jacket such that the adjustment increment for the test shot distance is determined when the spacing of the test shot is aligned with the division of minute of angle.

2. A scope adjustment calculating device for use with a scope and a firearm, comprising:

an outer wheel;

an inner wheel having an aperture and a diameter less than the diameter of the outer wheel; and printed indicia on the outer wheel and the inner wheel representing a plurality of adjustment increments, a plurality of divisions of minute of angle, a plurality of distances from a target, and a plurality of shot placement spacings from a target center where the adjustment increment for the division of minute is determined by aligning the test shot distance with the shot placement spacing.

3. A scope adjustment calculating device for use with a scope and a firearm comprising:

a chart for a selected division of minute of angle; and a plurality of adjustment increments that align with a plurality of distances from a target and a plurality of shot placement spacings from the target center.

4. The device of claim 3 wherein the device includes a plurality of charts with each chart having a different division of minute of angle.

* * * * *